US006065258A

United States Patent [19]

McClatchy

[11] Patent Number: 6,065,258

[45] Date of Patent: May 23, 2000

[54] WORK SPACE PARTITIONS HAVING GRAPHIC ARTWORK ON FABRIC

[76] Inventor: Carol McClatchy, 138 Franklin Ave., Souderton, Pa. 18964

[21] Appl. No.: 09/111,892

[22] Filed: Jul. 8, 1998

[51] Int. Cl.[7] ..... E04F 13/00

[52] U.S. Cl. ..... 52/238.1; 52/243; 52/311.1; 40/606; 40/611

[58] Field of Search ..... 40/606, 603, 605, 40/611; 52/243, 238.1, 311.1

[56] References Cited

U.S. PATENT DOCUMENTS

| | | | |
|---|---|---|---|
| D. 246,323 | 11/1977 | Kirk . | |
| 746,794 | 12/1903 | Coulet | 40/605 |
| 2,602,252 | 7/1952 | Shinn | 40/605 X |
| 3,583,341 | 6/1971 | Birdsong | 112/121.29 |
| 4,001,987 | 1/1977 | Coulthard | 40/611 X |
| 4,263,761 | 4/1981 | Kristoff . | |
| 4,367,000 | 1/1983 | Sparks et al. | 40/605 X |
| 4,635,410 | 1/1987 | Chumbley . | |
| 4,736,535 | 4/1988 | Rucker | 38/102.3 |
| 4,744,189 | 5/1988 | Wilson . | |
| 4,763,428 | 8/1988 | Fischer | 40/611 X |
| 5,062,234 | 11/1991 | Green | 43/1 |
| 5,259,562 | 11/1993 | Smart et al. | 242/62 |
| 5,309,686 | 5/1994 | Underwood et al. . | |
| 5,377,466 | 1/1995 | Insalaco et al. | 52/238.1 |
| 5,465,774 | 11/1995 | Smith | 40/611 X |
| 5,508,936 | 4/1996 | King et al. | 364/470 |
| 5,586,593 | 12/1996 | Schwartz . | |
| 5,626,926 | 5/1997 | Roberts | 40/611 X |
| 5,676,633 | 10/1997 | August | 600/27 |
| 5,681,259 | 10/1997 | August | 600/27 |

OTHER PUBLICATIONS

Jeff Schwartz, Desktop Patterns in *Prudential Leader*, p. 22. Pub. Jun. 1998.

*Primary Examiner*—Carl D. Friedman
*Assistant Examiner*—Phi Dieu Tran A
*Attorney, Agent, or Firm*—Michael F. Petock, Esq.

[57] ABSTRACT

A work space partition system having graphic artwork on fabric material covering the partitions is formed by panels having a frame, mounting a fabric material over a surface formed by said frame with the fabric material bearing on its exposed surface at least a portion of a graphic or scene. In a preferred embodiment, the graphic or scene on the fabric may be computer generated either utilizing a computer controlled loom for weaving, or a computer controlled knitting machine for generating the scene in the fabric. Alternatively, the computer controlled process may be utilized to form the scene by printing. The scene may be any graphic, scene or a natural scene, such as a beach scene, a mountain scene, a wilderness scene, a race track, a picture of other workers or leaders or any other suitable and pleasing scene. Further, the graphic or scene may be continued over multiple panels, with the computer generating a continuous or mating portion of the scene for each panel wherein the viewing of a plurality of connected panels creates a unitary scene.

27 Claims, 2 Drawing Sheets

WORK SPACE PARTITIONS HAVING GRAPHIC ARTWORK ON FABRIC

FIELD OF THE INVENTION

The present invention is directed to an improved work space partition system. More particularly, the present invention is directed to a work space partition system wherein graphic artwork is economically and efficiently provided to improve the work space environment and the level of innovation in the work force using the partition system.

BACKGROUND OF THE INVENTION

For a number of years, office space and other work spaces have been divided by partitions, usually including desks and computer work stations and the like. These partitions have been heretofore panels which are mounted together to provide some degree of privacy, reduce voice and other sound transmission from one worker to the next and to minimize distractions of one worker by another. These work space partitions have become quite common in dividing up large work areas into a number of cubicals, efficiently using the space to provide work areas for a larger number of persons than would be possible if each person had a private office constructed.

However, these work space partitions end up being drab and demoralizing. The drabness of a number of work space or office partitions reduces output and morale and can even lead to depression. Both lower morale and depression interfere with the ability of a worker to make decisions and to effectively and efficiently perform his function.

SUMMARY OF THE INVENTION

The present invention provides a number of advantages. It provides graphic artwork such as artistic scenery on work space divider panels which may be used to inspire innovation, improve morale, improve decision making and increase the output of workers. The graphic artwork, graphics or artistic scenery may be a scene, such as that of a beach, woods, mountains or any other appropriate graphic on a single panel or constructed of a number of coordinated panels. Further, the fabric may be provided with the graphic or scene quickly, efficiently and cost effectively by using a computer controlled weaving, knitting or printing system.

Briefly, in accordance with the present invention, a panel is provided for forming a work space partition which is comprised of a frame, means for mounting a fabric material over a surface formed by the frame and with the fabric material bearing on its exposed surface at least a portion of a graphic.

The panel fabric may be formed by a computer controlled process, including a computer controlled loom, a computer controlled knitting machine or a computer controlled printer.

The scene may be a natural scene, such as a beach scene, a mountain scene, a wilderness scene, a race track, a picture of co-workers or any other suitable graphic.

In accordance with the present invention, a second panel having a frame and means for mounting a fabric over a surface of the frame is provided wherein the fabric material bears on its exposed surface a continuation of the graphic. This process may be continued ad seriatim for three panels, four panels or more. The fabric may be replaced in the frame to change the graphic.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
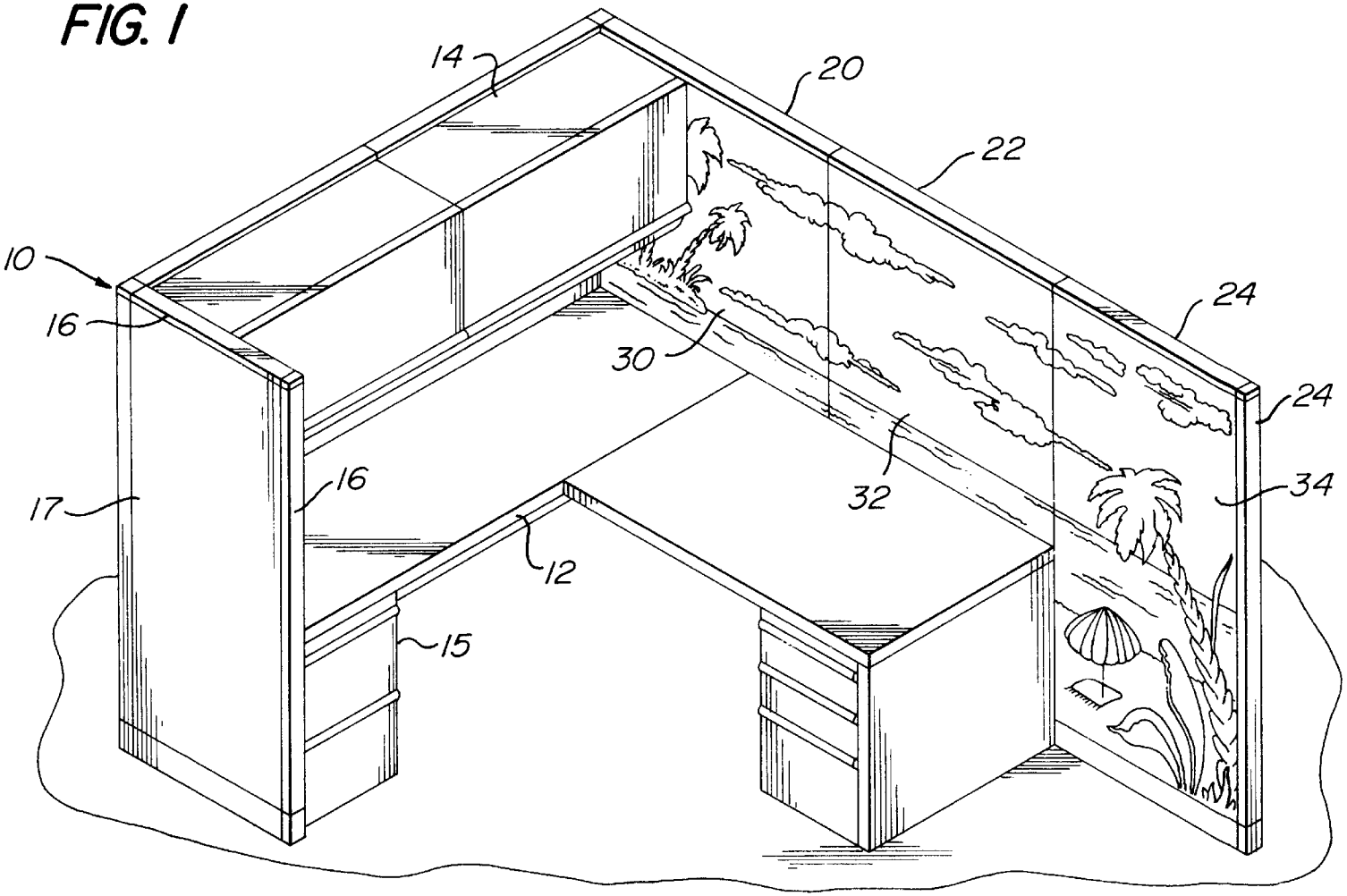
FIG. 1 is a view in perspective of work space partitions in accordance with the present invention having graphic or decorative scenes on fabric including a series of three frames having fabric in which the fabric on the second and third panel is a continuation of the scene.

Referring now to the drawings, wherein like numerals indicate like elements, there is shown in FIG. 1 a work space partition system 10. The work space may be provided with a desk 12 cabinets 14 and drawers 15. The work space partition system may be provided with a plurality of frames 16, 20, 22 and 24. Frames 16, 20, 22 and 24 may include means in their structure for mounting a fabric material over a surface formed by each frame, such as "U" shaped frame material as shown for clamping. The fabric may be permanently mounted or may be replaceable to allow a change of graphics or scenery, for example with a new worker. The frame itself may be the means for holding the fabric in place, merely clamping the fabric over the panel. This would allow it to be easily removed and replaced with a new scene. Other means for holding the fabric may be provided, including snaps, fabric barbs, staples into wooden panels held by the frames or other suitable fabric retention systems. Alternatively, the means for holding may be to adhesively mount the fabric to a metallic, wooden, plastic or other surface held together by the frame.

Frame 16 may have a blank panel as shown at 17 or it may have a fabric material which is held in place over the panel by the frame 16.

Frame 24 is provided with a fabric material 34 bearing on its exposed surface at least a portion of a graphic which is in the form of a scene which as illustrated in FIG. 1 includes clouds, water such as ocean, a beach, a beach umbrella, a palm tree and other portions of the scene. Of course various other types of scenes or scenery may be utilized including scenes of mountains, forests, clouds in the sky and these scenes or scenery may be selected to produce a desired mood or inspiration to the workers using the work space partition areas. These scenes may be selected to inspire innovation. A group picture of all of the employees in the department may be selected to encourage team effort or for other suitable reasons. The term graphics would not include a mere fabric or pattern design, but some form of a representation of scenery, objects, people or other inspirational images or the like.

Frame 22 or other suitable means secures a fabric material 32 bearing on its exposed surface at least a portion of a scene, which mates with or forms a continuation of the scene on fabric 34. Similarly, frame 20 contains a fabric material 30 bearing on its exposed surface at least a portion of a scene, which mates with or forms a continuation of the scene on fabric material 32.

Figure 2:
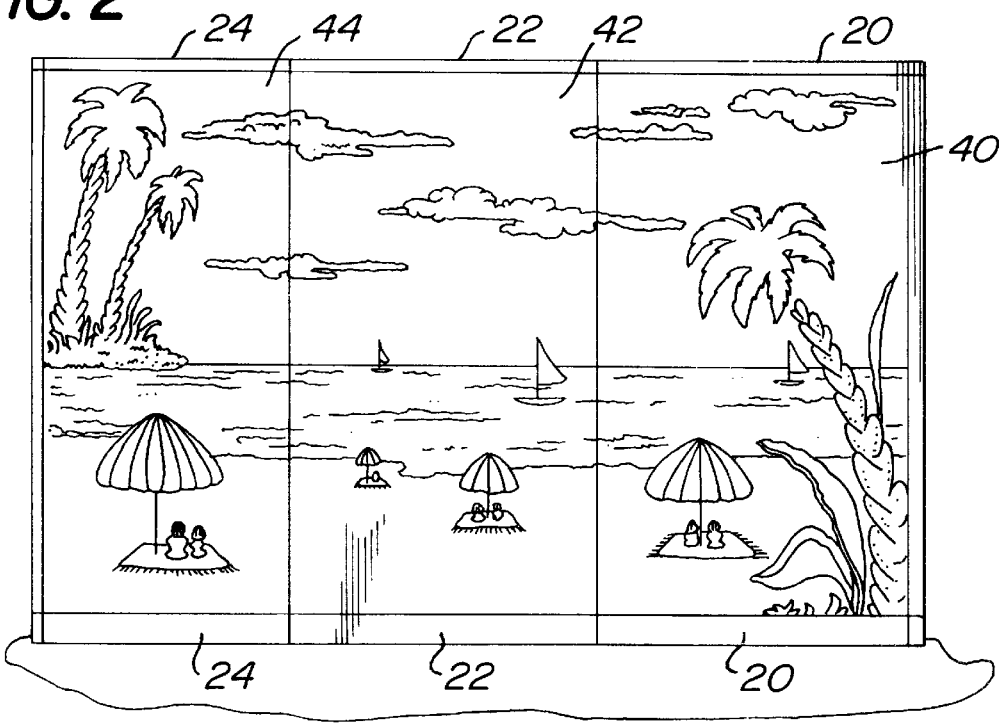
FIG. 2 is an elevation view of the back side of the panels having the scenes in FIG. 1, also showing three panels having fabric with scene portions coordinated to form a single scene.

Referring now particularly to FIG. 2, there is shown an elevation view of the back side of frames 20, 22 and 24. As seen in FIG. 2, fabric material 40 is mounted within frame 20 on the back side of the panel. Fabric material bearing a continuation of the scene on fabric 40 is mounted in frame 22. Fabric material 44, which is a continuation of the scene on fabric material 42 is mounted within frame 24. Fabric materials 40, 42 and 44 contain portions of an overall scene where each may be considered to be a continuation of the scene. Of course, these may be selected and arranged in different manners and the scenes on adjacent panels need not be a continuation of the scene on the adjacent panel, but may be independent scenes.

Figure 3:
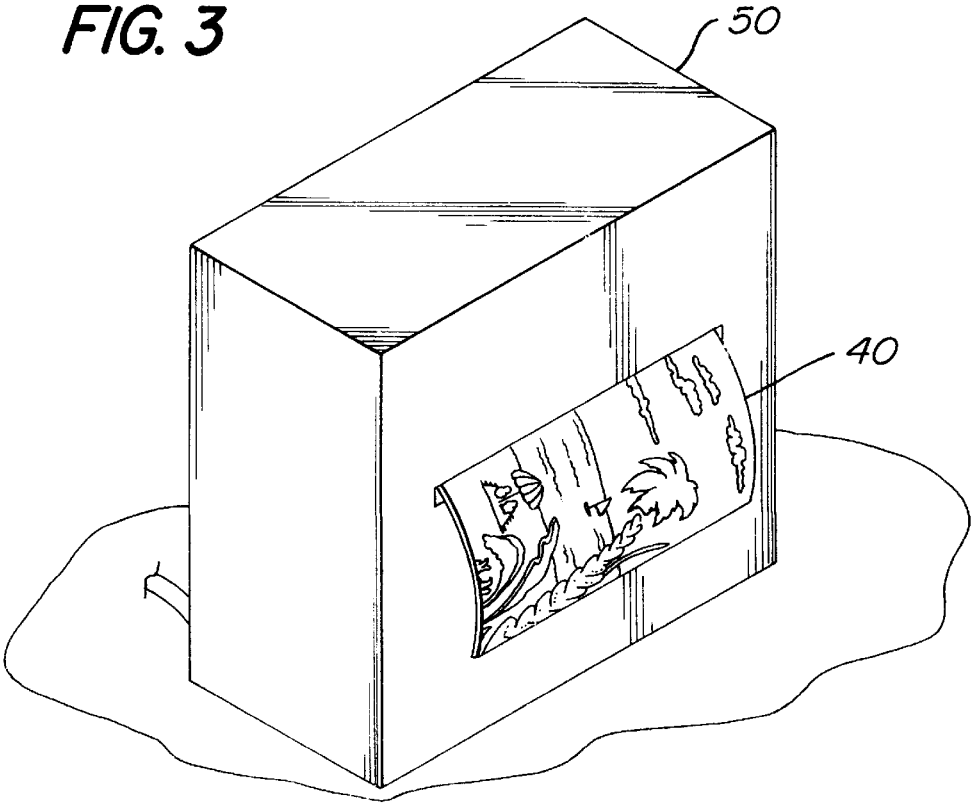
FIG. 3 is a view in perspective of a computer controlled apparatus wherein the fabric is being produced utilizing computer technology.

FIG. 3 is a view in perspective of a computer controlled apparatus 50 which may be a computer controlled loom, computer controlled knitting machine or a computer controlled screen printer. The computer controlled apparatus 50 is illustrated producing fabric material 40. The computer apparatus may receive a digital representation of the scene and economically produce the fabric with a scene. In other words, with the use of computer controlled generation, the scene may be digitally scanned and then subsequently used to generate signals, preferably digital, for the control of the computer loom, knitting machine or fabric printer to economically produce the fabrics containing graphics 30, 32, 34, 40, 42 and 44.

The, present invention may be embodied in other specific forms without departing from the spirit or essential attributes thereof and, accordingly, reference should be made to the appended claims, rather than to the foregoing specification as indicating the scope of the invention.

I claim:

1. A panel for forming a work space partition, comprising:

a rigid frame;

a fabric material;

means for mounting said fabric material over the entire surface formed by said frame; and said fabric material bearing on its exposed surface at least a portion of a graphic.

2. A panel in accordance with claim 1 wherein said graphic of said fabric is formed by a computer controlled apparatus.

3. A panel in accordance with claim 2 wherein said computer controlled process controls a loom.

4. A panel in accordance with claim 2 wherein said computer controlled process controls a knitting machine.

5. A panel in accordance with claim 2 wherein said computer controlled process controls a fabric printer.

6. A panel in accordance with claim 1 wherein said graphic is a natural scene.

7. A panel in accordance with claim 6 wherein said natural scene is a beach scene.

8. A panel in accordance with claim 1, and including a second panel having a frame and means for mounting a fabric over a surface of said frame, said fabric material bearing on its exposed surface a continuation of said graphic.

9. A panel in accordance with claim 1 wherein said means for mounting said fabric material over a surface formed by said frame allows said fabric to be replaced with a fabric having a different graphic.

10. A panel for forming a work space partition, comprising:

a first rigid frame adapted to be mounted vertically on a floor to form a partition and adapted to be connected to another frame;

a first fabric material;

means for mounting said first fabric material over the entire surface formed by said first frame; and said first fabric material bearing on its exposed surface at least a portion of a graphic.

11. A panel in accordance with claim 10 wherein said graphic of said first fabric is formed by a computer controlled apparatus.

12. A panel in accordance with claim 11 wherein said computer controlled apparatus is a computer controlled loom.

13. A panel in accordance with claim 11 wherein said computer controlled apparatus is a computer controlled knitting machine.

14. A panel in accordance with claim 11 wherein said computer controlled apparatus is a computer controlled fabric printer.

15. A panel in accordance with claim 10 wherein said graphic is a natural scene.

16. A panel in accordance with claim 15 wherein said natural scene is a beach scene.

17. A panel in accordance with claim 10, and including a second panel having a second frame and means for mounting a second fabric over a surface of said second frame, said second fabric material bearing on its exposed surface a continuation of said graphic.

18. A panel in accordance with claim 10 wherein said means for mounting said first fabric material over a surface formed by said first frame allows said first fabric to be replaced with a fabric having a different graphic.

19. Apparatus for providing improved office working conditions, comprising:

a first rigid frame adapted to be positioned on a floor and extend vertically upward from the floor for forming an office work space partition panel for separating desks and working spaces;

a first fabric bearing on at least one surface at least a portion of a graphic;

means for mounting said first fabric material to said first frame to form an office work space partition panel surface; and said at least one surface of said first fabric, bearing at least said portion of said graphic, being exposed for viewing on the entire surface of said office work space partition panel.

20. Apparatus for providing improved office working conditions in accordance with claim 19 wherein said first fabric, bearing on at least one surface at least a portion of a graphic, is produced by a computer controlled apparatus.

21. Apparatus for providing improved office working conditions in accordance with claim 20 wherein said computer controlled apparatus is a computer controlled loom.

22. Apparatus for providing improved office working conditions in accordance with claim 20 wherein said computer controlled apparatus is a computer controlled knitting machine.

23. Apparatus for providing improved office working conditions in accordance with claim 20 wherein said computer controlled apparatus is a computer controlled fabric printer.

24. Apparatus for providing improved office working conditions in accordance with claim 19 wherein said graphic is a natural scene.

25. Apparatus for providing improved office working conditions in accordance with claim 24 wherein said natural scene is a beach scene.

26. Apparatus for providing improved office working conditions in accordance with claim 19 including a second frame adapted to be positioned on a floor and extend vertically upward from the floor for forming an office work space partition panel for separating desks and working spaces, said second frame being connectable to said first frame;

a second fabric bearing on a least one surface at least a portion of a graphic, said second fabric material bearing on its exposed surface a continuation of said graphic;

means for mounting said second fabric material to said second frame to form an office work space partition panel; and said surface of said second fabric, bearing at least a portion of said graphic, being exposed for viewing along with said portion of said graphic on said first fabric to form a continuation of said graphic.

27. Apparatus for providing improved office working conditions in accordance with claim 19 wherein said means for mounting said first fabric material over a surface formed by said first frame allows said first fabric to be replaced with a fabric having a different graphic.

* * * * *